US005307954A

United States Patent [19]

Gick et al.

[11] Patent Number: 5,307,954

[45] Date of Patent: May 3, 1994

[54] MULTI-COLOR FABRIC PAINT PRODUCT

[75] Inventors: James W. Gick, Cota de Caza; Edward J. Kalfayan, Clovis; James T. Nakahara; Bradley C. Shelton, both of Fresno, all of Calif.

[73] Assignees: Duncan Enterprises, Fresno; Gick Publishing Inc., Irvine, both of Calif.

[21] Appl. No.: 794,523

[22] Filed: Nov. 19, 1991

[51] Int. Cl.[5] ..... B65D 35/00

[52] U.S. Cl. ..... 222/94; 222/215; 427/286; 401/35; 401/47; 401/183; 401/184; 401/265

[58] Field of Search ..... 401/265, 35, 47, 183, 401/184; 427/286; 222/94, 215

[56] References Cited

U.S. PATENT DOCUMENTS

| | | | |
|---|---|---|---|
| 2,758,755 | 8/1956 | Schafler | 222/215 X |
| 3,197,071 | 7/1965 | Kuster | 222/94 |
| 3,693,837 | 9/1972 | Yuhas . | |
| 3,788,520 | 1/1974 | Dukess | 222/94 |
| 3,881,529 | 5/1975 | Mannara . | |
| 3,952,782 | 4/1976 | Mannara . | |
| 3,954,126 | 5/1976 | Piana . | |
| 4,163,523 | 8/1979 | Vincent . | |
| 4,437,584 | 3/1984 | Connors et al. . | |
| 4,490,177 | 12/1984 | Shioi et al. . | |
| 4,496,796 | 1/1990 | Harris . | |
| 4,506,710 | 3/1985 | Sawvel . | |
| 4,545,819 | 10/1985 | Shioi et al. . | |
| 4,604,139 | 8/1986 | Shioi et al. . | |
| 4,666,723 | 5/1987 | Invernizzi et al. . | |
| 4,715,518 | 12/1987 | Moore . | |
| 4,814,160 | 3/1989 | Carter . | |
| 4,821,926 | 4/1989 | Battegazzore . | |
| 4,826,044 | 5/1989 | Volfson . | |
| 4,838,461 | 6/1989 | Santerelli . | |
| 4,856,679 | 8/1989 | Czech . | |
| 4,858,785 | 8/1989 | Wilkinson . | |
| 4,907,726 | 3/1990 | Harris . | |
| 4,923,684 | 5/1990 | Ibrahim et al. . | |
| 4,927,059 | 5/1990 | Fiedler et al. . | |
| 4,928,592 | 5/1990 | Moshier et al. . | |
| 4,961,517 | 10/1990 | Tkac | 222/94 |
| 4,966,205 | 10/1990 | Tanaka . | |
| 4,969,767 | 11/1990 | Madden . | |
| 4,978,037 | 12/1990 | Schuckmann . | |
| 4,979,646 | 12/1990 | Andris . | |
| 4,991,744 | 2/1991 | Von Schuckmann . | |
| 5,000,355 | 3/1991 | Pritchard . | |
| 5,016,783 | 5/1991 | Hayes . | |

*Primary Examiner*—Shrive Beck
*Assistant Examiner*—Vi Duong Dang
*Attorney, Agent, or Firm*—Knobbe, Martens, Olson & Bear

[57] ABSTRACT

Two different colored fabric paints are placed in separate sections of a single container so that a two color stripe may be dispensed and applied to the fabric. One bottle has no partition between the paints. In three other elliptically-shaped bottles, a partition extends generally across the shorter dimensions of the container cross section. The partition is directly on the minor axis in one bottle, is angled with respect to the minor axis in a second, and has a Z-shape in a third.

7 Claims, 4 Drawing Sheets

MULTI-COLOR FABRIC PAINT PRODUCT

BACKGROUND OF THE INVENTION

1. Field of the Invention

The present invention is related to colored fabric paints in which paint is dispensed from a container onto fabric to decorate the fabric.

2. Description of the Prior Art

Currently, fabric paint is dispensed from a hand held container to custom decorate fabric or clothing. These fabric paints are typically sold to the general public to enable the custom decorating of clothing, such as the addition of names, designs etc. to the clothing. Many of these fabric paints are of a three dimensional type which bond to the fabric, but are not totally absorbed into the material, so a substantial portion of the paint remains above the surface of the fabric to enable three dimensional decoration.

The dispensing containers for fabric paints are designed to discharge a thin stream of paint to enable precise application for detailed designs and writing with pen-like ease. The dispensing containers are usually plastic bottles that, when squeezed, force the fabric paint out through the nozzle in a single stream.

If multiple colors are required, multiple bottles of fabric paint are used, each bottle dispensing an individual color of fabric paint. When multiple colors are to be used side by side, careful application is required, to prevent the colors from unintentionally overlapping or to prevent too wide a space between the two streams of color. Thus if multiple colors are desired in close proximity, there are application difficulties, and much time and effort is needed for careful application. As fabric paints are becoming more popular, so are more complex designs. Some designs may require the application of multiple colors of fabric paint adjacent to each other. There is thus a need for an improved way to place multiple adjacent colors of paint on fabric.

The bottles of fabric paint are filled using very large filling mechanisms with filling tubes suspended from the mechanisms leading to the bottles below. The filling tubes are placed just above the neck of the bottles and the paint is charged into the bottle using the paint injectors.

It is well known in the prior art, as disclosed in U.S. Pat. Nos. 4,490,177, 4,545,819 and 4,604,139 assigned to Sakura Color Products, that if two colors of ink are desired to be dispensed from a single container, they must be of different chemical compositions The Sakura patents disclose a method of mixing two types of ink together in a dispenser wherein each color is of a different absorption level. When the two types of ink are dispensed together and come into contact with the material, the two colors will separate, as one will be absorbed into the fabric and one will remain above the surface of the material. Thus the chemical composition of the two different types of paints facilitates the separation of the two colors. There is, however, still a need for a way to apply multiple colors of a similar chemical composition while not allowing for substantial mixing of the colors in the bottle or during application.

SUMMARY OF THE INVENTION

The present invention provides for the simultaneous dispensing of a plurality of individual colors of fabric paint from a single container. When the container is squeezed, the fabric paint is forced out through the nozzle in a thin cord-like stream of color, and the stream allows for three dimensional decoration of the fabric. The paint of the present invention bonds with the fabric, but is not entirely absorbed by the material. Instead, a significant portion of the fabric paint remains above the surface of the fabric and produces the desired three dimensional painting effect.

The container used in the present invention is a small plastic bottle that narrows to a neck in which a nozzle is inserted. The nozzle narrows to a small writing tip which is used to direct the paint stream. In one of the embodiments, where the bottle contains no internal walls to separate the fabric paint colors, the viscosity of the fabric paint is such that the thickness of the paint itself initially keeps the colors from blending together in the bottle.

The container is filled using a plurality of conventional fabric paint filling machines placed close together, with one machine for each color used. The fabric paint from each filling machine is channeled down a dispensing tube, one for each color, with the tubes meeting at a junction. At the junction, the larger dispensing tubes are scaled down to tubes of a smaller diameter and placed side by side so that they can fit within the neck of the bottle to be filled. In the embodiment with no internal wall, each individual fill mechanism is run at a controlled rate to achieve the desired proportion of each color in the container.

The pumping rate is also carefully monitored to insure that air bubbles are minimized in the filling process. Air bubbles are a problem because they can move around in the container without an internal wall, during shipment, and if one is sufficiently large, it could act as a mixing agent and blend the fabric paint colors together.

In another embodiment, the different colored paints are separated in the bottle by a semi-flexible partition. The horizontal cross-section of the bottle with a partition is preferably in the shape of an ellipse because it facilitates the use of the bottle. The partition is preferably placed such that the bottle is divided, generally along the minor axis of the elliptical cross section. In one arrangement the partition is coincident with the minor axis. In another arrangement, the partition extends through the center of the cross section, but at an angle of about 45° with respect to the axes. In a third arrangement, the partition has a Z or S shape with its ends and center on the minor axis.

The proper procedure for utilizing the elliptically shaped bottle is to squeeze the bottle across its wide sides. This allows the two paints to be squeezed out fairly evenly. During the squeezing, the partition aligned with the minor axis may buckle slightly, while the angled partitions bend at the joints. The elliptical design enables the user to know where to squeeze the bottle, as well as observe the paint colors easily through transparent bottle material

BRIEF DESCRIPTION OF THE DRAWINGS

The present invention will be better understood from the description of the preferred embodiment given below, taken in connection with the drawings, in which like numbers refer to like parts throughout the description, and in which.

DETAILED DESCRIPTION OF FIGURES 1-6

Figure 1:
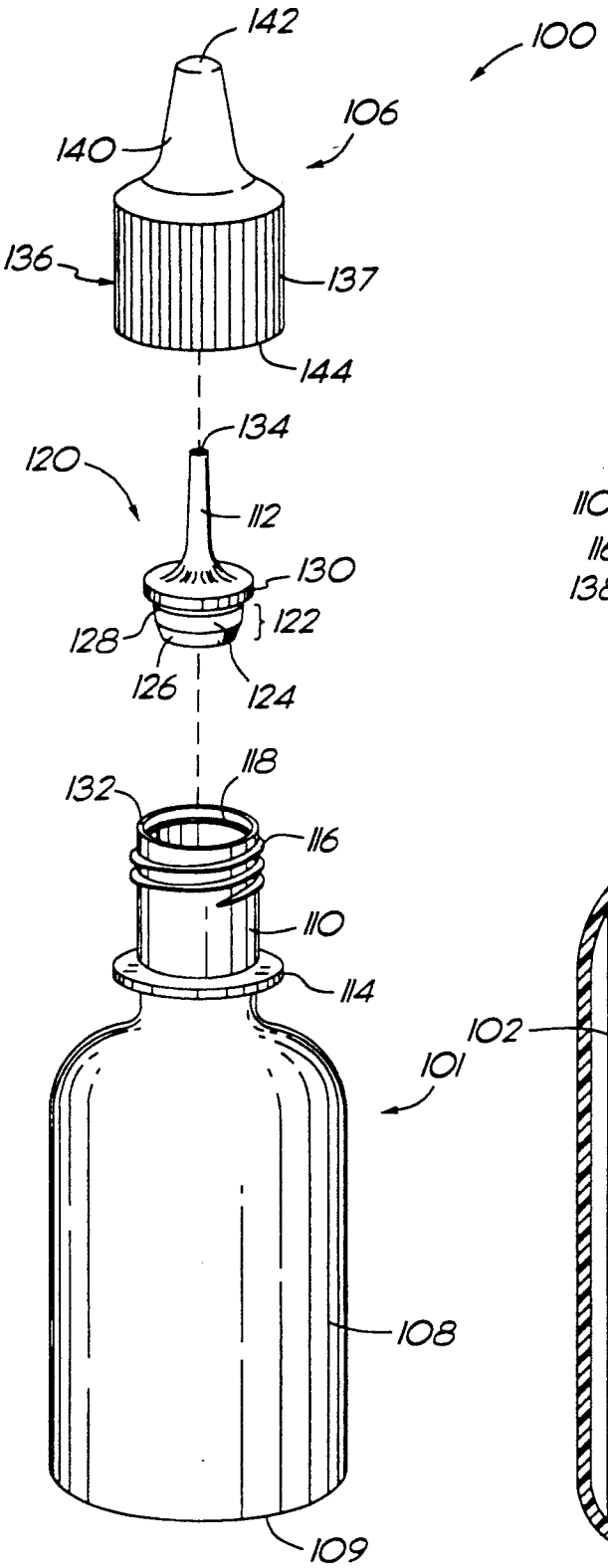
FIG. 1 is an exploded view illustrating the container of one embodiment of the present invention.
Figure 2:
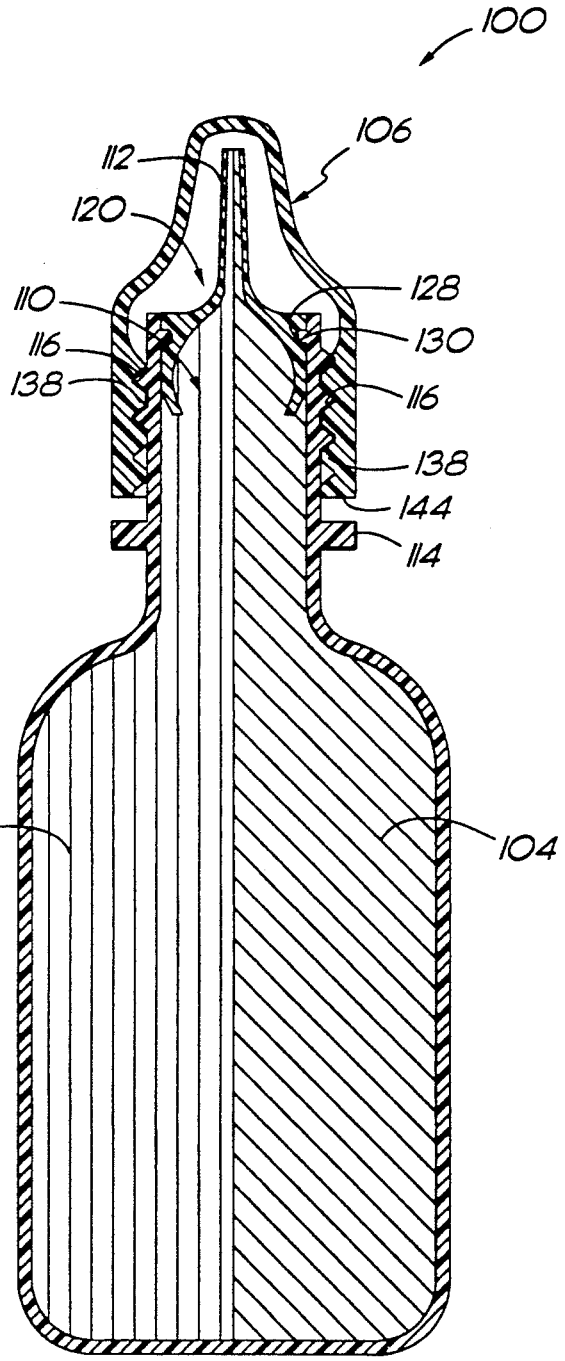
FIG. 2 is a cross sectional view of one embodiment taken vertically along the length of a bottle filled with substantially equal proportions of two colors of fabric paint.

Referring to FIGS. 1 and 2, two colors of fabric paint 102 and 104, of substantially equal proportions, are placed in the same container 100. The container 100 advantageously comprises a small plastic bottle 101 that holds a small quantity of fabric paint and is covered by a cap 106. The main portion of the bottle, the body 108, is of a substantially cylindrical shape that narrows at the top to a neck portion 110 in which is inserted the nozzle piece 120. The cap 106 advantageously covers the nozzle piece 120, and is held in place by a mechanism on the neck portion of the bottle 101. The body of the bottle holds a majority of the fabric paint 102, 104 and has a hollow cylindrical shape closed on one end to form a flattened base 109, such that the bottle will sit in an upright orientation when placed on a flat surface.

The body 108 is defined by the hollow cylinder with an approximate diameter of 1.2 inches and a length of approximately 2.0 inches that tapers to a significantly smaller neck 110. The neck 110 has an external flange like shoulder 114 extending approximately 0.2 inches from the neck 110 at approximately ⅓ of the length the neck toward the body 108. The neck 110 has a plurality of engaging threads 116 at the top of the neck 110. The neck 110 also has an internal shoulder 118 used to engage a nozzle piece 120.

The nozzle piece 120 has an elongated writing tip 112, a radially extending shoulder 130, a smaller diameter fastening portion 122 which contains a groove 128, a main portion 124 and a tapered conical end 126. The parts 124, 126 have an outer diameter sized to fit inside the neck 110. The fastening portion 122 comprises a groove 128 and a hollow cylinder having a first portion 124 extending a short distance before tapering inward in a cone-like manner to form a second portion 126. The tapered portion 126 eases the insertion of the nozzle 120 into the bottle neck 110 with the inner shoulder 118 of the neck 110 fitting into the groove 128, and the radially extending shoulder 130 of the nozzle piece 120 abutting the inner shoulder 118 so as to form a removable seal. The radially extending shoulder 130 of the nozzle 120 is sized to provide a surface flush with the upper rim 132 of neck 110 to provide an additional seal. The mating portions of the nozzle piece 120 and the neck 110 may be advantageously sized to provide an interference fit. The second portion of the nozzle piece 120, the writing tip 112, is a hollow cylinder approximately .65 inches long that tapers to an opening 134 at the end.

The nozzle 120 is placed into the bottle 101 which has been filled with the fabric paints 102, 104. When the nozzle 120 is placed inside the neck 110, the paint 102, 104 that was in the neck 110 is displaced into the nozzle piece 120 as it is inserted into the neck 110. The paint should preferably completely fill the neck 110, the fastening portion 122, and the writing tip 112 with out allowing any space for an air bubble. This assembly step requires careful attention to ensure that excess air is not allowed to enter the bottle 101 and nozzle 120 which could allow mixing during shipment.

The cap 106 is provided to cover the neck 110 and writing tip 112 of the bottle 101. The cap 106 comprises two concentric portions 136, 140. The first portion 136 is a hollow cylinder sized to cover the neck 110 of the bottle 101 and has a plurality of receiving threads 138 aligned to receive the engaging threads 116 from the neck 110 of the bottle 101. The first portion 136 also has several raised ridges 137 to provide a grippable surface so that the cap 106 will not slip through a persons fingers when the cap 106 is engaged with the neck 110 of the bottle 101. The second portion 140 tapers from the cylinder of the first portion 136 to a significantly smaller cylindrical top 142 that covers the writing tip 112. The cap 106 is provided to prevent clogging of the writing tip 112 with foreign objects and to keep the fabric paint from drying out. When the cap 106 is assembled with the bottle, the engaging threads 116 are aligned with the receiving threads 138 by rotating the cap 106 clockwise about the neck 110 of the bottle 101 until the threads 116 and 138 are fully engaged and the bottom rim 144 of the cap 106 is proximate to the extending shoulder 114 of the neck 110.

Figure 3:
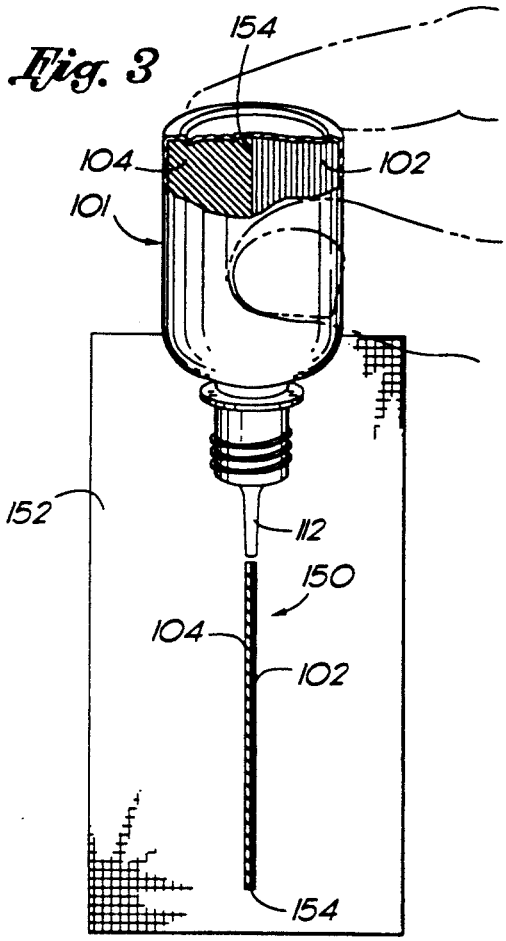
FIG. 3 is a perspective view illustrating the use of the bottle of FIG. 2 to dispense a single strand of multi-colored paint on a piece of fabric.

As shown in FIG. 3, the bottle 101 when squeezed between the thumb and forefinger, as shown in phantom, dispenses two different colors of fabric paint 102 and 104 in a single stream 150 from the writing tip 112. The bottle 101 is moved along the surface of the material 152 while he bottle 101 is squeezed and the fabric paint is dispensed in the pattern that is defined by the motion of the bottle 101. Once the pressure is released from the bottle 101 the fabric paint is no longer dispensed. Preferably the cap 106 is placed on to the bottle 101 before the pressure is substantially released to prevent large amounts of air from entering the bottle 101.

The two colors of fabric paint 102 and 104 are substantially separated along the length of the bottle about a dividing seam 154 and when they are dispensed from the bottle 101 they remain substantially separate about the seam 154. The bottle 101 contains no physical divider to keep the two colors 102 and 104 separate, in that the chemical and physical characteristics including the viscosity of the fabric paints helps keep them substantially separated. It has been found however, that some mixing may occur in shipment and use, depending on the viscosity.

Fabric paints have high solids content which are partially responsible for the high viscosity There are two types of fabric paints: (1) dimensionals; and (2) brushables. Dimensionals come in five types: (1) opaque shiny; (2) iridescent; (3) glitters; (4) fluorescent; and (5) glow-in-the-dark. Brushables come in the first four types. Dimensionals have a viscosity of 120–125 k.u. (Kreb units) consisting of 50–60% nonvolatiles. Brushables can have a viscosity anywhere from 95–107 k.u. with nonvolatiles making up 30–65%.

As there is no physical divider, care must be taken to maintain the integrity of the separate colors of the fabric paint. It is preferred to avoid shaking the bottle 101. An air bubble acts as a mixing agent during shipping as it moves around in the bottle 101 and blends the colors 102, 104 together as it passes from one color region to the next. The bottle should be shipped and stored in an upright position, such that the base 109 is sitting flat on a horizontal surface and the nozzle 120 is oriented in a perpendicular relation to the surface. It is preferred that the entire contents of the bottle 101 be used when first opened, since some mixing may occur during repeated inversions of the container and during storage.

In the normal use of the bottle 101, the dividing seam 154 between the two colors 102 and 104 extends vertically in the middle of the bottle 101 as illustrated in the perspective view of FIG. 3. Using this orientation the two colors of fabric paint 102, 104 will be dispensed from the bottle in a single stream 150 of substantially separate adjacent colors 102, 104. In addition, several other types of painting effects can be achieved. By rotating the bottle 101 one half turn while dispensing the fabric paint, the colors can be positioned so that primarily only one color is visible. By oscillating the rotation, alternating colors can be made visible, e.g., 102 then 104 then 102 etc. As the bottle is rotated, the color that is on the top of the bottle will be the visible color of the stream. If the bottle is held so that only one color is visible from the perspective view of the bottle, it will be the color primarily visible in the stream of paint on the fabric. There are a number of possible color configurations in addition to those discussed above. The above uses are intended to be illustrative of the possible uses of the present invention and are not intended to limit the invention.

Figure 4:
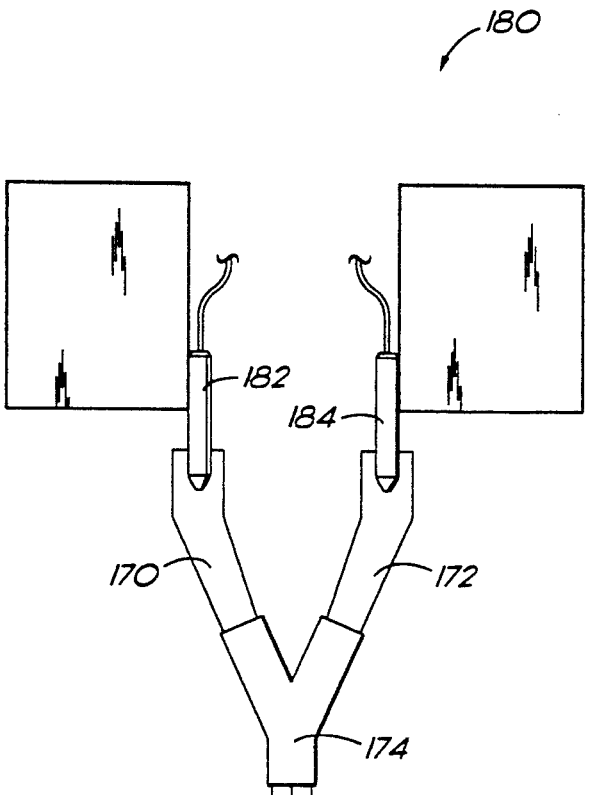
FIG. 4 is a cross sectional view taken vertically along the length of the bottle of an alternate embodiment of the present invention illustrating the use of three colors of fabric paint.
Figure 4:
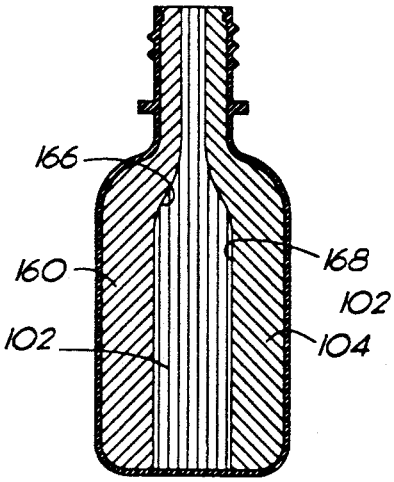

In another embodiment as illustrated in FIG. 4, three colors of fabric paint of approximately equal proportions can be dispensed from a single container. The three colors 102 104, 160 remain in substantially vertical columns in the bottle 101 and are divided along two junctures or seams 166, 168 where each of the two adjacent colors abut each other. There may exist some slight blending along the seams 166, 168. Advantageously, the colors will be dispensed in a single rope of three separate and distinct colors 160 102, 104. The application of the three colors 160, 102, 104 is similar to the application of the two colors 102, 104 except the effects will vary with the addition of the extra color 160. While more colors are technically possible, no more than three, and preferably only two, colors are used.

Figure 5:
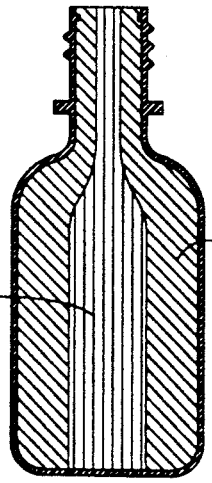
FIG. 5 is a cross sectional view taken vertically along the length of the bottle of an alternate embodiment of the present invention illustrating an alternate ratio of two colors of paint.

While advantageously, the ratio of the two colors 102, 104 are substantially equal, the ratios of fabric paint colors do not need to be substantially even. An unequal ratio is especially advantageous when one color is darker than the other, such as black, as it is a very dominating color. Ratios as great as 30% of a first color and 70% of a second color are believed suitable, although greater ratios may occasionally be desired. An exemplary embodiment is illustrated in FIG. 5 using the colors of the original embodiment 102 simulating the lighter color, with an approximate ratio of 70%, and 104 simulating the darker color with an approximate ratio of 30%. It is also illustrated that even though the ratio of the two colors have changed, the alignment of the fabric paint along two substantially vertical columns have remained.

In order to obtain the desired color ratios without mixing the colors in the container not having a partition, careful attention must be paid to the method in which the bottle 101 is filled with the colored fabric paint 102, 104. The dispensing equipment of the prior art is too large to allow for two conventional machines to be used in the normal manner to fill the bottle with paint.

Figure 6:
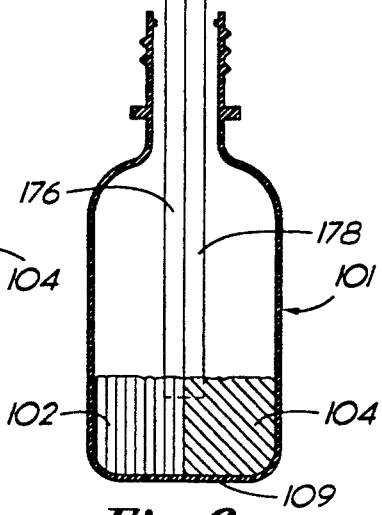
FIG. 6 is a partial cross sectional view taken vertically along the length of the bottle to illustrate a schematic representation of one of the embodiments of the filling process of the present invention.

As illustrated in FIG. 6, to achieve the preferred embodiment of a proportioned dual color fabric paint product as illustrated in FIGS. 2 and 3, the normal fill tubes 170, 172 are joined together using a fitting 174 which extends laterally to accommodate the size of the dispensing equipment 180. As shown in FIG. 6, a "Y" shaped fitting 174 can be used to fill the bottle 101 with two colors of fabric paint 102, 104. If the normal fill tubes 170, 172 are too large to fit into the bottle 101 at the same time, the fitting 174 can also be used to narrow the fill tubes 170, 172 to corresponding scaled tubes 176, 178 of a smaller diameter. The fitting 174 is also used to properly align the colors 102, 104 to enable them to fill the bottle 101 side by side without substantial mixing, as the fill tubes remain separate. The filling injectors 182, 184 are synchronized to ensure that the two colors 102, 104 are charged into the bottle 101 at the same rate and at substantially the same time to insure even filling. If desired, different flow rates or tube sizes can be used to achieve different predetermined ratios of colors. The fabric paint is charged into the bottle 101 in substantially vertical columns with the viscosity of the fabric paint, maintaining the separation of colors 102, 104 during filling.

In one fill method, the multiple colors of fabric paint are charged from the fitting 174 at the neck 110 of the bottle 101 until the bottle 101 is substantially full. The rate of filling or the size of the scaled fill tubes 176, 178 and fitting 174 can be varied to achieve the desired ratio of colors. The start and stop time of the process is carefully monitored to minimize the presence of air bubbles being injected into the bottle 101 to insure any such bubbles remain at the top of the bottle 101 after it is filled. The bottle 101 is preferably filled to the rim 132 of the neck 110 portion to insure that no space has been left for air pockets to form when the nozzle piece 120 is inserted into the neck 110. Current practice allows for some small bubbles in the fabric paint, because if they are small enough, the bubbles will not be able to migrate together through the more viscous paint.

In an alternative filling method illustrated in FIG. 6, the fitting 174 is shaped with a substantially elongated portion of scaled tubes 176, 178 such that the fitting 174 and the tubes 176, 178 can be inserted all the way into the neck 110 of the bottle 101 and extend to the base 109. The fitting 174 is then inserted with the scaled fill tubes 176, 178 attached until it almost reaches the base 109 of the bottle 101 before the filling begins. The fitting 174 is pulled up as the fill tubes are charged with fabric paint, and the bottle 101 fills with the two colors 102, 104 of fabric paint. The procedure of pulling an internal fill mechanism up while the container is filling is known in the art, but the method of the present invention improves this process and enables the filling of multiple colors of fabric paint simultaneously without mixing the colors. The method of the present invention is particularly advantageous as it avoids the entrapment of bubbles in the fabric paint, and reduces the number and size of air bubbles that form during filling, thereby helping to keep the colors 102, 104 substantially separate.

DETAILED DESCRIPTION OF FIGURES 7-11

Figure 7:
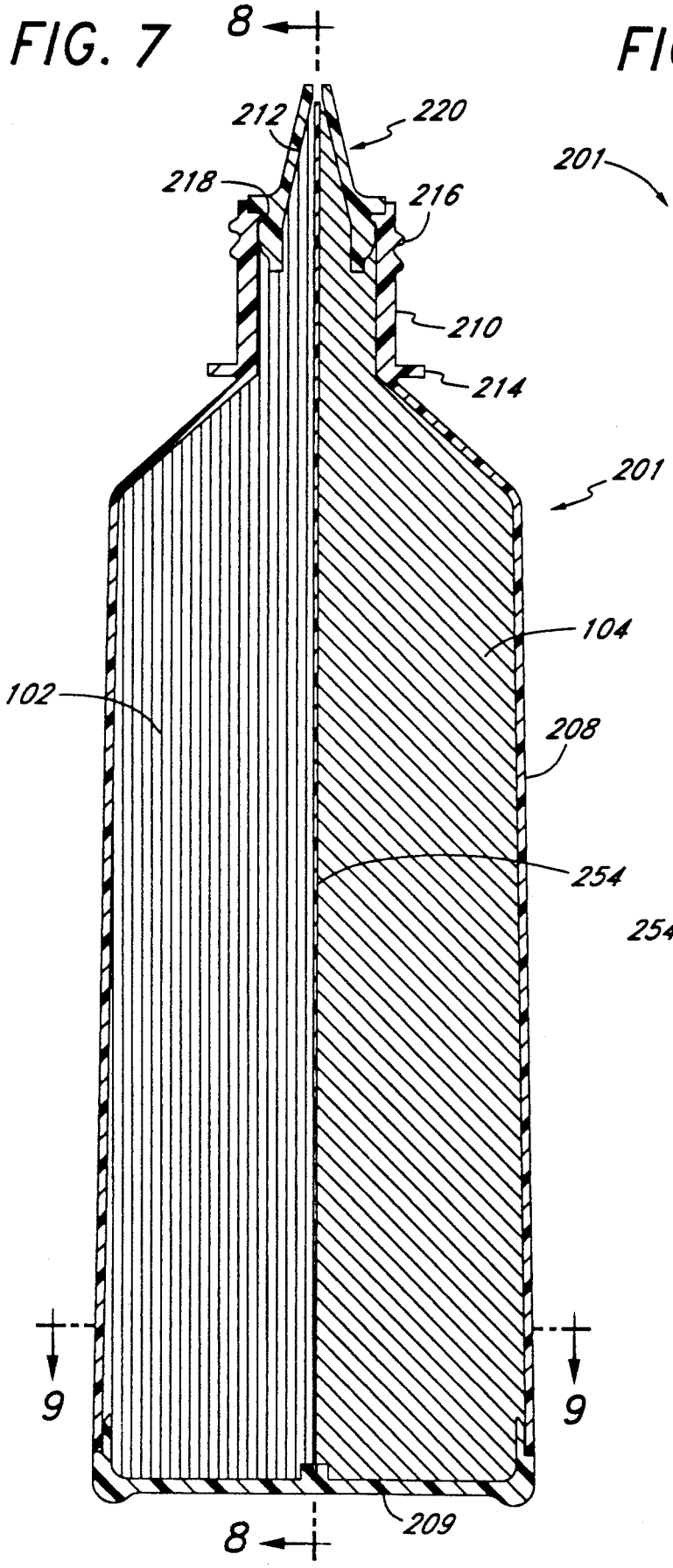
FIG. 7 is a vertical cross-sectional view of a preferred form embodiment of the present invention having an internal partition along the length of the container of FIG. 9.
Figure 8:
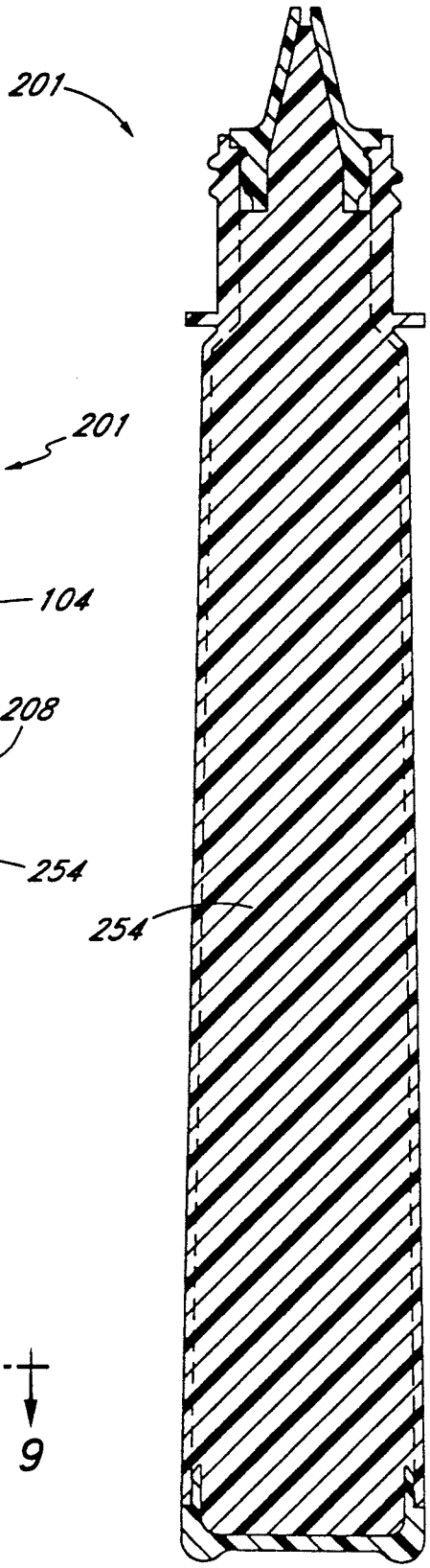
FIG. 8 is a vertical cross-sectional view on line 8—8 of FIG. 7.
Figure 9:
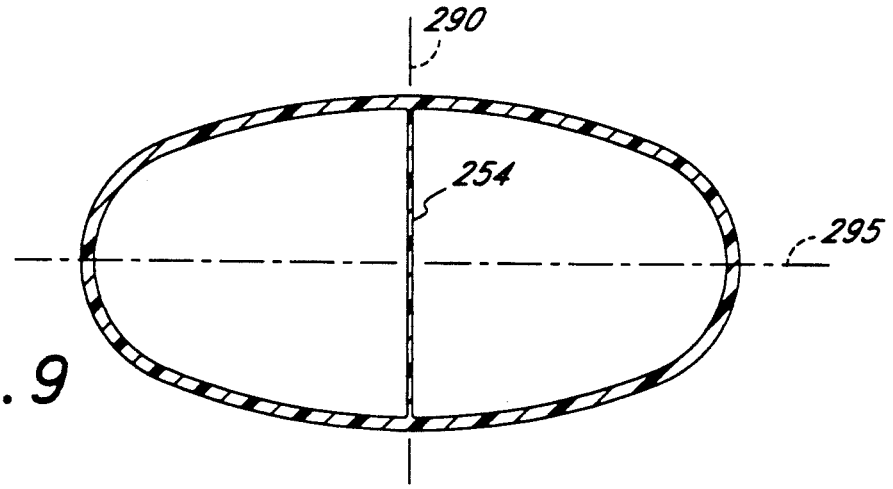
FIG. 9 is a horizontal cross-sectional view taken on line 9—9 of FIG. 7.

FIGS. 7, 8 and 9 show a flexible bottle 201 having a body 208 with a generally elliptically-shaped horizontal cross section. The container illustrated has a thin partition 254 extending across the minor axis of the container cross section and extending from a base 209 throughout the height and width of the container, and into the neck 210, and the conical nozzle 220, including its tip 212. The base has a slot 255 opening upwardly to receive the lower end of the partition to prevent mixing (shown in FIGS. 7 and 8)—after the word "mixing". The partition 254 is preferably thinner than the wall of the body 208, making it semi-rigid yet flexible to allow for buckling. A prototype of the body 208 has a cross section with a major axis with an approximate radius of 1.40 inches and a minor axis with an approximate radius of 0.250 inches. The length of the body 208 is approximately 3 inches. The neck 210 is cylindrical with an outer diameter of about 0.5 inches and a length of approximately 0.6 inches. The neck 210 has an external flange like shoulder 214 extending approximately 0.2 inches from the base of the neck 210. The top of the neck 210 has a plurality of engaging threads 216. The neck 210 also has an internal shoulder 218 used to engage a nozzle piece 220. In this embodiment, there is no need to worry about air bubbles from a color mixing standpoint because the partition 254 will not allow the two paint colors 102, 104 to mix.

When the bottle is squeezed to dispense the paint, it should be held substantially as shown for the bottle in FIG. 3, and with the partition 254 extending between the thumb and the fingers. When the bottle 208 is squeezed along the flat sides of the elliptical cross section, the partition 254 will buckle slightly. In a preferred form of the container, the wall of the container is about 0.030 inches, and the partition tapers from the wall thickness on its ends to about half that spaced from the ends.

Figure 10:
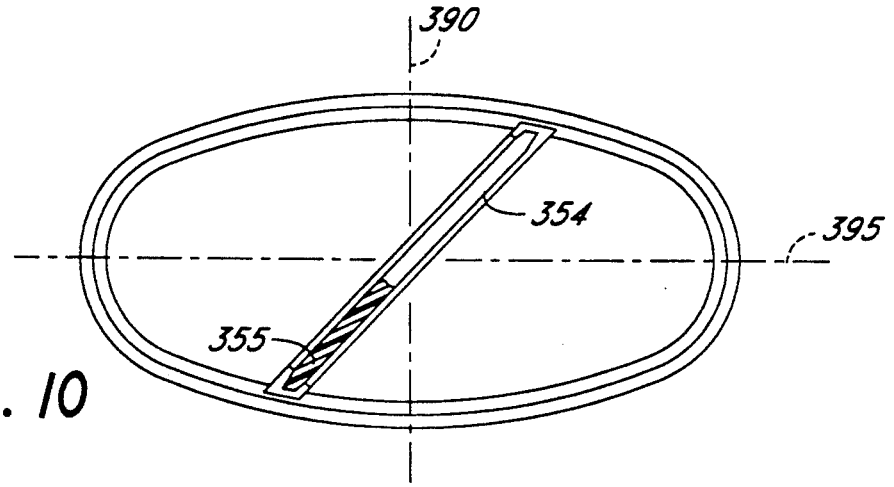
FIG. 10 is a top, plan view of the base of an embodiment of the container with an alternate placement of the partition, shown in cross section.

FIG. 10 shows the base 309 of an alternate embodiment of a bottle wherein a partition 355 and the base slot 354 extend through the center of the bottle, oriented at approximately a 45° angle to both the major 395 and minor 390 axes of the elliptical cross section. This arrangement provides for a more easily squeezable bottle in that the partition 355 may not have to buckle. Instead it mainly flexes at its end joints, or becomes somewhat of an S shape.

Figure 11:
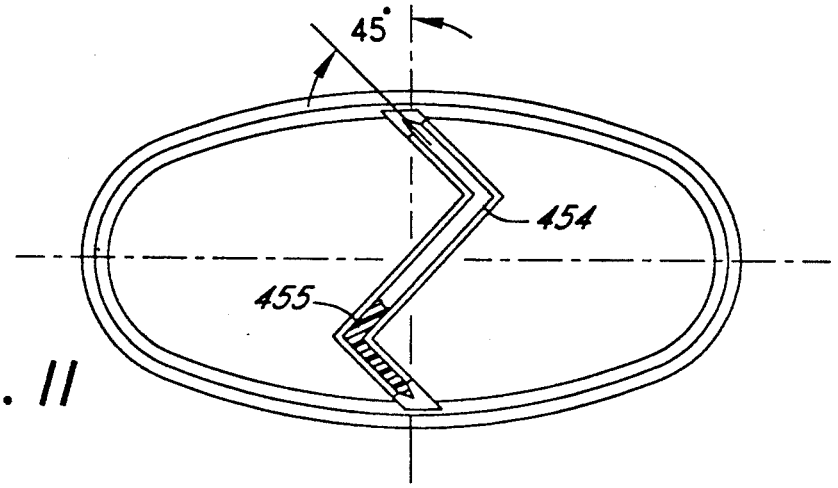
FIG. 11 is a top, plan view of the base of an embodiment of the container with an alternate placement and shape of the partition, shown in cross section.

FIG. 11 shows the base 409 of another embodiment of a bottle wherein a partition 455 and a base slot 454 have a substantially Z or S-shaped cross section. The ends of the partition and the groove are on the minor axis 490. This shape also facilitates squeezing of the bottle. When the bottle is squeezed along the wider sides of the elliptical cross section, the partition 455 will flex at the ends of its straight segments.

Although the invention has been described with reference to specific embodiments, the description is intended to be illustrative of the invention and is not intended to be limiting. Various modifications and applications may occur to those skilled in the art without departing from the true spirit and scope of the invention as defined in the appended claims.

What is claimed is:

1. A device for applying fabric paint to the surface of fabric comprising a container having an outlet nozzle and a body wall which is movable inwardly to force contents of the container out of the nozzle, first and second quantities of fabric paint positioned in said container in a manner such that they are not mixed with each other, said second quantity having a different appearance than the first quantity, said paint quantities being positioned in said container in a manner such that when said movable wall is moved to force paint out of the nozzle, a continuous flow of both quantities of paint out said nozzle in a side-by-side single strand, but unmixed, relation provides a combined flow of striped appearance when applied to said fabric, said container includes a partition which divides the container into two compartments, said partition extending from the bottom to the top of the container and into the nozzle so that said two paint quantities are separated within the container and do not contact each other until flowing out of the nozzle, and said container has a cross-sectional shape wherein one dimension extending across the container through the center of the cross-section is longer than a dimension across said container which is perpendicular to the first dimension, and said partition is located such that said compartments are substantially on opposite sides of the shorter dimension.

2. A device for applying fabric paint to the surface of fabric comprising a container having an outlet nozzle and a body wall which is movable inwardly to force contents of the container out of the nozzle, first and second quantities of fabric paint positioned in said container in a manner such that they are not mixed with each other, said second quantity having a different appearance than the first quantity, said paint quantities being positioned in said container in a manner such that when said movable wall is moved to force paint out of the nozzle, a continuous flow of both quantities of paint out of said nozzle in a side-by-side single strand, but unmixed, relation provides a combined flow of striped appearance when applied to said fabric, said container includes a partition which divides the container into two compartments, said partition extending from the bottom to the top of the container and into the nozzle so that said two paint quantities are separated within the container and do not contact each other until flowing out of the nozzle, and said container has a substantially elliptical cross-section having a major axis and a minor axis which intersect at the center of the ellipse, and said compartments are situated substantially on opposite sides of the minor axis.

3. A device for applying fabric paint to the surface of fabric comprising a container having an outlet nozzle and a body wall which is movable inwardly to force contents of the container out of the nozzle, first and second quantities of fabric paint positioned in said container in a manner such that they are not mixed with each other, said second quantity having a different appearance than the first quantity, said paint quantities being positioned in said container in a manner such that when said movable wall is moved to force paint out of the nozzle, a continuous flow of both quantities of paint out of said paint nozzle in a side-by-side single strand, but unmixed, relation provides a combined flow of striped appearance when applied to said fabric, said container includes a partition which divides the container into two compartments, said partition extending from the bottom to the top of the container and into the nozzle so that said two paint quantities are separated within the container and do not contact each other until flowing out of the nozzle, said partition being thinner than said exterior walls of said container, and said partition tapers from the container's exterior wall to a thickness about half that of the exterior walls.

4. A device for applying viscous, flowable materials onto a surface comprising a container having a hollow body and an outlet nozzle, the container including side walls which are sufficiently flexible to allow contents of the container to be squeezed out of the nozzle by a user's hand, said container including an inner partition extending across the container and into the nozzle to divide the container into separate compartments for receiving materials which have appearances different from each other so that when the materials are squeezed from the container, a stripe of the two materials may be applied to said surface, said container having a cross-section which is longer in one dimension through the center of the container than a second dimension through the container, said partition being located such that said compartments are substantially situated on opposite sides of said shorter dimension, such that said container has substantially an elliptical cross-section.

5. A device for applying viscous, flowable materials onto a surface comprising a container having a hollow body and an outlet nozzle, the container including side walls which are sufficiently flexible to allow contents of the container to be squeezed out of the nozzle by a user's hand, said container including an inner partition extending across the container and into the nozzle to divide the container into separate compartments for receiving materials which have appearances different from each other so that when the materials are squeezed from the container, a stripe of the two materials may be applied to said surface, said container having a cross-section which is longer in one dimension through the center of the container than a second dimension through the container, said partition being located such that said compartments are substantially situated on opposite sides of said shorter dimension, and said partition extends at an angle of about 45° with respect to the longer dimension.

6. A device for applying viscous, flowable materials onto a surface comprising a container having a hollow body and an outlet nozzle, the container including side walls which are sufficiently flexible to allow contents of the container to be squeezed out of the nozzle by a user's hand, said container including an inner partition extending across the container and into the nozzle to divide the container into separate compartments for receiving materials which have appearances different from each other so that when the materials are squeezed from the container, a stripe of the two materials may be applied to said surface, said container having a cross-section which is longer in one dimension through the center of the container than a second dimension through the container, said partition being located such that said compartments are substantially situated on opposite sides of said shorter dimension, and said partition has substantially a Z or S-shaped cross section.

7. A device for applying fabric paint to the surface of fabric, comprising a container having an outlet nozzle and a body wall which is movable inwardly to force contents of the container out of the nozzle, first and second quantities of fabric paint positioned inside container in a manner such that they are not mixed with each other, said second quantity having a different appearance than the first quantity, said paint quantities being positioned in said container in a manner such that when said movable wall is moved to force paint out of the nozzle, a continuous flow of both quantities of paint out of said nozzle in a side-by-side single strand, but unmixed relation, provides a combined flow of striped appearance when applied to said fabric, said container includes a partition which divides the container into two compartments, said partition extending from the bottom to the top of the container and including an end which extends into an outer tip of the nozzle so that said two paint quantities are separated within the container and the nozzle and do not contact each other until flowing out of the nozzle, said container has a cross-sectional shape wherein a first dimension extending across the container through the center of the cross section is longer than a second dimension across said container which is perpendicular to said first dimension.

* * * * *